United States Patent [19]

Ross et al.

[11] Patent Number: 4,872,278

[45] Date of Patent: Oct. 10, 1989

[54] MOTION SENSITIVE ANIMATED FIGURE DISPLAY

[76] Inventors: Bruce E. Ross; Gail C. Ross, both of 8 Kiska Ct., Randallstown, Md. 21133

[21] Appl. No.: 186,222

[22] Filed: Apr. 26, 1988

[51] Int. Cl.[4] ..... G09F 19/08

[52] U.S. Cl. ..... 40/424; 40/613

[58] Field of Search ..... 40/424, 613, 421, 425, 40/413, 416–421; 446/147, 149, 322, 351

[56] References Cited

U.S. PATENT DOCUMENTS

| | | | |
|---|---|---|---|
| 187,139 | 6/1877 | Howard | 40/424 |
| 412,394 | 4/1889 | Kelly | 40/424 |
| 539,579 | 9/1895 | Ferree | 40/424 |
| 600,486 | 10/1898 | Bradshaw | 446/351 |
| 613,503 | 11/1898 | DuBois | 40/424 |
| 1,217,309 | 2/1917 | Howe | 446/322 |
| 1,224,044 | 7/1917 | Thurman | 40/413 |
| 1,811,320 | 4/1931 | Kerr | 40/424 |
| 1,818,624 | 8/1931 | Hover | 40/424 |
| 1,832,789 | 9/1931 | Polak | 40/424 |
| 1,863,463 | 11/1932 | Bolinger | 40/424 |
| 1,956,280 | 1/1934 | Goetz | 40/424 |
| 2,002,675 | 4/1935 | Outcault | 40/424 |
| 2,058,417 | 1/1936 | Currie | 40/424 |
| 2,099,277 | 11/1937 | Peterson | 40/424 |
| 2,110,646 | 12/1938 | Currie | 40/424 |
| 2,133,824 | 10/1938 | Meisel | 40/613 |
| 2,363,438 | 11/1944 | Popper | 40/424 |
| 2,389,606 | 11/1945 | Borregard | 40/423 |
| 3,487,571 | 9/1970 | Plati | 40/424 |
| 3,936,965 | 7/1976 | Raun et al. | 40/419 |

FOREIGN PATENT DOCUMENTS

| | | | |
|---|---|---|---|
| 625207 | 4/1927 | France | 40/424 |

*Primary Examiner*—Gene Mancene
*Assistant Examiner*—J Hakomaki

[57] ABSTRACT

An improved figure display for use in moving vehicles or on other moveable objects having an attachment means for resiliently mounting all portions of the figure display so that they oscillate in closely spaced vertical planes. The figure display includes a means, for controlling and coordinating oscillatory movements of the figure portions with respect to each other such that the animation effect is enchanced.

2 Claims, 2 Drawing Sheets

MOTION SENSITIVE ANIMATED FIGURE DISPLAY

BACKGROUND—FIELD OF INVENTION

This invention relates to motion sensitive figure displays, especially to those which are used on moving vehicles or other moving objects.

BACKGROUND—DESCRIPTION OF PRIOR ART

Many advertisers and toy and novelty producers recognize the eye catching, entertaining and amusing advantages of sign and display figures which are placed in moving vehicles and utilize the motion (swaying, jolting, and jarring) and acceleration and deceleration of said vehicles to provide energy for the movement of said figures.

Heretofore a wide variety of motion sensitive figure displays have been proposed for use in moving vehicles and on other moving objects such as doors. Shortcomings in previously known constructions made it difficult to realistically animate these figure displays.

One type of motion sensitive figure display is shown in U.S. Pat. Nos. 187,139 to Howard, Feb. 6, 1877, and 412,394 to Kelly, Oct. 8, 1889. In both of these devices, the figure moves as a whole unit and is itself not animated. These devices use a spring to oscillate said figure in only one plane providing minimal animation.

A second type of motion sensitive figure display embodies movable extremities (head, limb, hand, or foot). Many examples of this type can be found. Some typical examples are shown in U.S. Pat. Nos. 539,579 to Ferree, May 21, 1895; 600,486 to Bradshaw, Mar. 8, 1898; 2,058,417 to Currie, Oct. 27, 1936; and 3,487,571 to Plati, Jan. 6, 1970. As with the previously mentioned devices, these devices use a spring to oscillate said movable extremities in only one plane. Since the body of the figure is fixed, overall animation is not possible.

A third type of motion sensitive figure display is shown in U.S. Pat. No. 1,832,789 to Polak, Nov. 17, 1931. This device uses a a figure which has moving portions in several planes. The mechanism in this device is not designed to provide sustained movement which would be required to effectively animate the figure. Also, the body of the figure must remain fixed, further limiting the animation effect.

A fourth type of motion sensitive figure display is shown in U.S. Pat. No. 1,956,280 to Goetz, Apr. 24, 1934. This device uses two springs to operate moving appendages of the figure in the same plane. Since this construction requires the body of the figure to remain fixed, the animation of the figure is thus limited. Also, said appendages oscillate independently of each other. There is no means for controlling or coordinating the oscillatory movement of said appendages with respect to each other.

A fifth type of motion sensitive figure display is shown in U.S. Pat. No. 2,363,438 to Popper, Nov. 21, 1944. This device uses several springs each operating identical portions of a figure on several planes. Each of said portions and said springs are mounted separately to the fixed body of said figure and oscillate independently of each other. There is no means for controlling or coordinating the oscillatory movement of the figure portions with respect to each other. Here again the fixed body of the figure limits the animation of said figure.

A sixth type of motion sensitive figure display is shown in U.S. Pat. No. 3,936,965 to Ravn, Feb. 10, 1976. This device uses two mechanisms to operate portions of a figure in one plane. This device is designed to maintain one of two predetermined stable positions until the forces of acceleration or deceleration cause it to switch to the other position. Since the device moves instantaneously and does not sustain movement it cannot effectively animate a figure.

Most users of motion sensitive animated figure displays, therefore, would find it desirable to have a device which significantly improves the animation effect of said figure displays.

OBJECTS AND ADVANTAGES

Accordingly we claim the following as our objects and advantages of the invention: to provide an improved motion sensitive animated figure display in which said figure is animated with sustained, life-like, lively movement that provides the illusion of life to said figure.

Another object and advantage is to provide a motion sensitive animated figure display wherein an attachment means is provided for oscillating all portions of said figure, thus enhancing the animation effect.

Another object and advantage of the invention is to provide a regulating means to means for controlling and coordinating oscillatory movement of the different portions of said figure display with respect to each other, thus enhancing the animation effect.

Another object and advantage of said motion sensitive animated figure display is to provide a simple design which when disassembled can be easily and compactly packaged. Also, said device would be easy to assemble and mount by the user requiring no tools or special skills.

Readers will find further objects and advantages of the invention from a consideration of the ensuing description and the accompanying drawings.

DRAWING FIGURES

DRAWING REFERENCE NUMERALS

Figure 1:
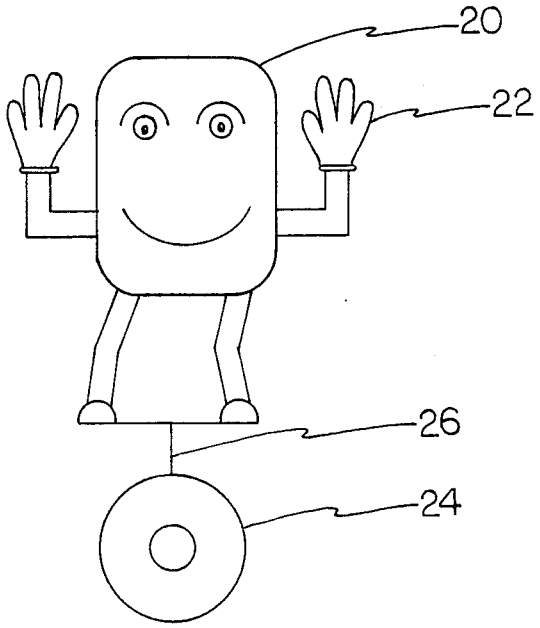
FIG. 1 shows a front view of a motion sensitive animated figure display according to the invention.

20 front display panel
22 rear display panel
23 window
24 suction cup
25 smooth interior surface
26 front spring
28 rear spring
30 torsion bar
32 front panel mount
34 rear panel mount
36 weight

MOTION SENSITIVE ANIMATED FIGURE DISPLAY—DESCRIPTION

FIG. 1 shows a front view of a motion sensitive animated figure display according to the preferred embodiment of the invention. Different portions of said figure display are supported on the front surfaces of front display panel 20 and rear display panel 22 wherein said panels are preferrably made of plastic.

Figure 3:
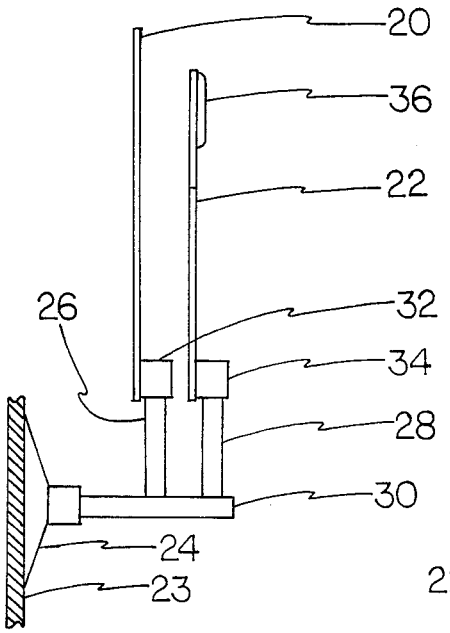
FIG. 3 shows a side view of such display.
Figure 4:
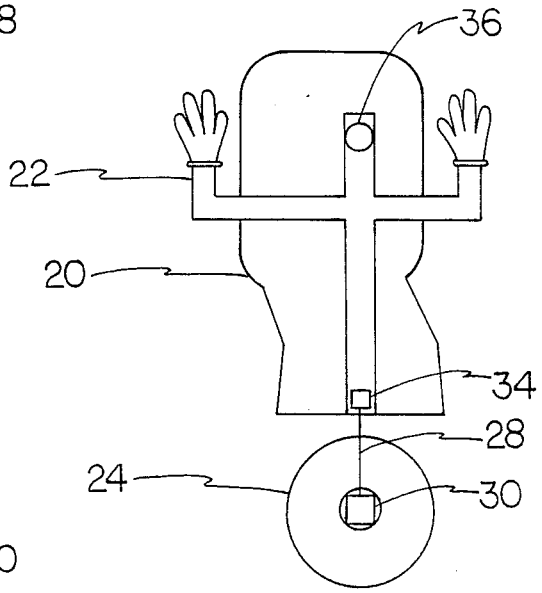
FIG. 4 shows a rear view of such display.

As shown in FIG. 3, the rear of said front display panel 20 has a front panel mount 32 preferrably formed as a part of said plastic front display panel 20. FIG. 3 and FIG. 4 show the rear of said rear display panel 22 having a rear panel mount 34 preferrably formed as a part of said plastic rear display panel 22. In addition, said rear display panel 22 is weighted with a weight 36 affixed to the rear of said rear display panel 22. The front panel mount 32 and rear panel mount 34 are similar in construction.

Figure 2:
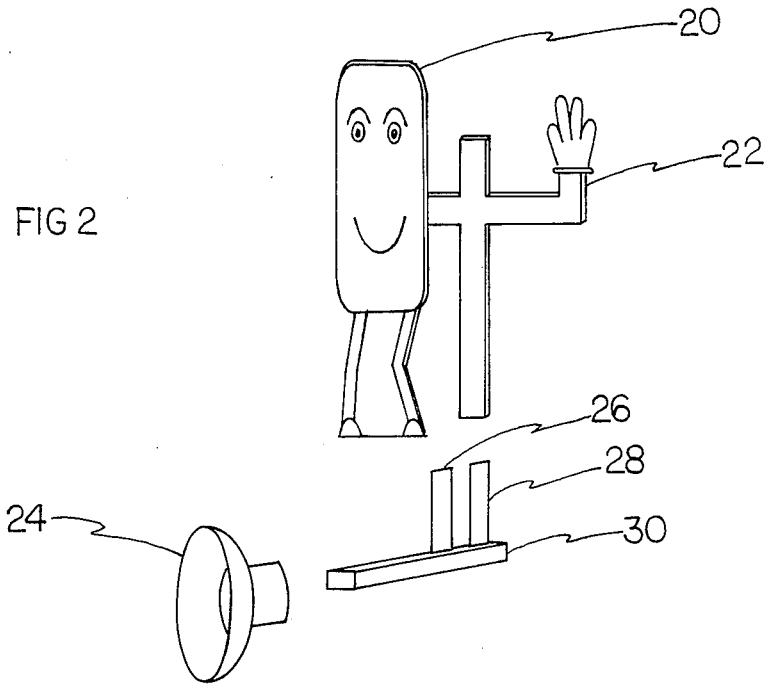
FIG. 2 shows an exploded, perspective view of such display.

FIG. 2 shows a means, for controlling and coordinating oscillatory movement comprised of a front spring 26, rear spring 28, and a support which is a torsion bar 30. Said front spring 26 and said rear spring 28 are flat springs whose lower ends are embedded into said torsion bar 30. Said torsion bar 30 being made of a resilient material such as plastic or rubber. As shown in FIG. 3, the upper ends of front spring 26 and rear spring 28 fit tightly into the front panel mount 32 and rear panel mount 34, respectively. This construction orients said front display panel 20 and said rear display panel 22 in closely spaced vertical planes.

Figure 5:
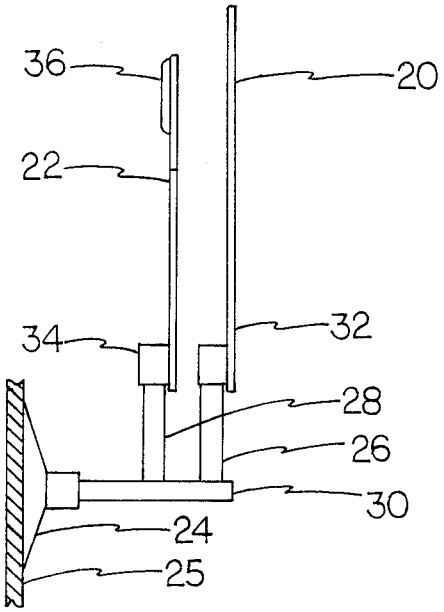
FIG. 5 shows a side view of a reversed assembly.

As shown in FIG. 3, FIG. 4, and FIG. 5, the front end of said torsion bar 30 fits snugly into the end of a suction cup 24 to provide support for said figure display.

MOTION SENSITIVE ANIMATED FIGURE DISPLAY—OPERATION

The motion sensitive animated figure display of FIG. 1 will animate said figure display with sustained, life-like, lively movement that provides the illusion of life to said figure when said figure display is mounted in a moving vehicle or on a moving object.

To assemble said figure display, the user needs no special tools or training. The availiable end of the torsion bar 30 (that is, the end opposite the end where the front spring 26 and rear spring 28 are embedded) is fitted snuggly into the rear receiving end of the suction cup 24 as shown in FIG. 2 and Fig 3. Said suction cup 24 is the supporting means for said motion sensitive animated figure display.

The front panel mount 32 which is on the rear of the front display panel 20 is then fitted on to the top or free end of the front spring 26 as shown in FIG. 3. Likewise, the rear panel mount 34 which is on the rear of the rear display panel 22 is then fitted on to the top or free end of the rear spring 28 as shown in FIG. 3.

The aforementioned positions of said front display panel 20 and said rear display panel 22 would be used when said display figure is intended to be placed on the inside of a vehicle window with the figure display being viewed through said window from the outside of said vehicle. The user can reverse the assembly by mounting said front display panel 20 on said rear spring 28 and said rear display panel 22 on said front spring 26 so that the display can be viewed from inside the vehicle as shown in the reversed assembly of FIG. 5.

The assembled motion sensitive animated figure display of this embodiment uses a suction cup 24 as a supporting means. The assembly can be mounted in a substantially vertical orientation by pressing the suction cup 24 to any glass surface 23 or smooth surface 25 as shown in FIG. 3 and FIG. 5, respectively.

When said figure display is subjected to the movement of the object to which it is attached, the attachment means and the means, for controlling and coordinating oscillatory movement herein shown as front spring 26, rear spring 28, and torsion bar 30 will cause said front display panel 20 and said rear display panel 22 to begin oscillating.

The means, for controlling and coordinating oscillatory movement of the figure portions with respect to each other thus enhances the animation effect. The means for controlling and coordinating oscillatory movement of this embodiment is comprised of several interconnected elements which work together to control and coordinate the oscillatory movement of said front display panel 20 with respect to said rear display panel 22. This surprising result is achieved by the mechanical coupling of said front display panel 20 and said front spring 26 to said rear display panel 22 and said rear spring 28 through said torsion bar 30. The timing of the oscillatory movement of said front display panel 20 with respect to said rear display panel 22 can be controlled and coordinated through the proper adjustment of the weight and size of said front display panel 20 and said rear display panel 22, and length and resilience of said front spring 26, said rear spring 28 and said torsion bar 30.

CONCLUSION, RAMIFICATIONS AND SCOPE OF INVENTION

Thus, the reader will see that the motion sensitive animated figure display provides eye catching motion, and sustained, life-like, lively movement that is surprisingly realistic and can be enjoyed by persons of almost any age.

While the above description contains many specificities, the reader should not construe these as limitations on the scope of the invention, but merely as exemplifications of preferred embodiments thereof. Those skilled in the art will envision many other possible variations within its scope. For example skilled artisans will readily be able to change the dimensions and shapes of the various embodiments. They will also be able to make the motion sensitive animated figure display of different materials such as wood or metal. They can make many variations of the resilient means including attachment means and means, for controlling and coordinating oscillatory movement including using different types of springs. They can place the springs at various angles with respect to each other. They can make many variations of the support including using different types of torsion bars. They can weight the display panels differently. They can support said motion sensitive animated figure display differently. Accordingly, the reader is requested to determine the scope of the invention by the appended claims and their legal equivalents, and not by the examples which have been given.

We claim:

1. A motion sensitive animated figure display, comprising:

display means, comprised of separate display panels, for supporting different portions of said figure display, attachment means, interconnecting the display panels to a support such that the display panels are in closely spaced vertical planes and whereby all portions of said figure display are animated, wherein said attachment means are resilient and oscillating motion of the display panels is achieved, means, for controlling and coordinating the oscillatory movement of each of said display panels with respect to each other, whereby the animation effect is enhanced, mounting means for vertically supporting said figure display.

2. The motion sensitive animated figure display of claim 1, wherein said attachment means is comprised of multiple flat springs and the support is a torsion bar.

* * * * *

UNITED STATES PATENT AND TRADEMARK OFFICE

CERTIFICATE OF CORRECTION

PATENT NO. : 4,872,278

DATED : October 10, 1989

INVENTOR(S) : Bruce E. Ross, et al

It is certified that error appears in the above-identified patent and that said Letters Patent is hereby corrected as shown below:

Col. 2, line 29, delete "regulating means to".

Col. 4, line 45, delete "resilient means including".

Signed and Sealed this

Fourteenth Day of August, 1990

*Attest:*

HARRY F. MANBECK, JR.

*Attesting Officer*

*Commissioner of Patents and Trademarks*